US011783780B2

(12) United States Patent
Jo et al.

(10) Patent No.: US 11,783,780 B2
(45) Date of Patent: Oct. 10, 2023

(54) GATE DRIVER FOR SEPARATELY CHARGING A NODE VOLTAGE OF BUFFERS AND DISPLAY DEVICE INCLUDING THE SAME

(71) Applicant: LG Display Co., Ltd., Seoul (KR)

(72) Inventors: Sunghak Jo, Paju-si (KR); Seongku Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/559,982

(22) Filed: Dec. 22, 2021

(65) Prior Publication Data

US 2022/0208114 A1 Jun. 30, 2022

(30) Foreign Application Priority Data

Dec. 29, 2020 (KR) ..... 10-2020-0186713

(51) Int. Cl.

| | |
|---|---|
| ***G09G 3/32*** | (2016.01) |
| ***G09G 3/3266*** | (2016.01) |
| *G09G 3/3258* | (2016.01) |
| *G09G 3/3208* | (2016.01) |

(52) U.S. Cl.

CPC ..... *G09G 3/3266* (2013.01); *G09G 3/32* (2013.01); *G09G 3/3208* (2013.01); *G09G 3/3258* (2013.01); *G09G 2310/021* (2013.01); *G09G 2310/0264* (2013.01); *G09G 2310/0286* (2013.01); *G09G 2310/0291* (2013.01); *G09G 2330/00* (2013.01); *G09G 2330/02* (2013.01); *G09G 2330/12* (2013.01)

(58) Field of Classification Search

CPC ..... G09G 3/3266; G09G 2310/0286; G09G 2310/0291; G09G 2330/02; G09G 3/32; G09G 3/3208; G09G 3/3258; G09G 2310/021; G09G 2310/0264; G09G 2330/00; G09G 2330/12

See application file for complete search history.

(56) References Cited

U.S. PATENT DOCUMENTS

2013/0100007 A1* 4/2013 Yamamoto ..... G09G 3/3677 377/64
2013/0222357 A1* 8/2013 Tseng ..... G09G 3/3677 345/212

(Continued)

FOREIGN PATENT DOCUMENTS

KR 10-20150025784 A * 3/2015 ..... G09G 3/3677
KR 10-2020-0081071 A 7/2020
KR 10-2138318 B1 8/2020

*Primary Examiner* — Adam J Snyder
(74) *Attorney, Agent, or Firm* — Fenwick & West LLP

(57) ABSTRACT

Proposed is a gate driver and a display device having the same. The gate driver includes a plurality of stage circuits, wherein each of the plurality of stage circuits includes a shift register configured to control charging and discharging of a Q node and a QB node, and a plurality of output buffers sequentially connected to the shift register, wherein each of the output buffers includes a first transistor configured to transmit a voltage of the Q node to a Q' node, a pull-up transistor configured to output a clock signal to a gate line in response to a voltage of the Q' node, and a pull-down transistor configured to output a low-potential voltage to the gate line in response to a voltage of the QB node.

15 Claims, 7 Drawing Sheets

(56) References Cited

U.S. PATENT DOCUMENTS

| | | | | |
|---|---|---|---|---|
| 2014/0044228 | A1* | 2/2014 | Jang | G09G 3/3677 377/64 |
| 2014/0241487 | A1* | 8/2014 | Yamazaki | G09G 3/3677 377/64 |
| 2015/0015474 | A1* | 1/2015 | Miyake | G09G 3/3677 345/100 |
| 2020/0135132 | A1* | 4/2020 | Tanaka | G09G 3/3677 |
| 2020/0394960 | A1* | 12/2020 | Yuan | G09G 3/3266 |

* cited by examiner

GATE DRIVER FOR SEPARATELY CHARGING A NODE VOLTAGE OF BUFFERS AND DISPLAY DEVICE INCLUDING THE SAME

CROSS-REFERENCE TO RELATED APPLICATIONS

This application claims priority under 35 U.S.C. 119(a) to Republic of Korea Patent Application No. 10-2020-0186713 filed on Dec. 29, 2020, which is incorporated by reference herein in its entirety.

BACKGROUND OF THE INVENTION

Field of the Invention

The present disclosure relates to a gate driver and a display device including the same.

Description of the Related Art

A display device includes a display panel including a plurality of pixels, a gate driver and a data driver for driving the pixels, and a timing controller. The gate driver is provided with stage circuits that are connected to gate lines, and the stage circuits apply gate signals to the gate lines that are connected thereto in response to control signals received from the timing controller.

SUMMARY OF THE INVENTION

In embodiments, there is provided a gate driver and a display device including the same, in which the gate driver is configured such that multiple buffers are connected to one shift register so as to allow gate signals to be output to a plurality of gate lines.

In addition, in embodiments, there is provided a gate driver and a display device including the same, in which the gate driver is provided with a transistor for separately charging and discharging a gate voltage of pull-up transistors that are provided at buffers.

According to an aspect of the present disclosure, there is provided a gate driver including: a plurality of stage circuits, wherein each of the plurality of stage circuits may include: a shift register configured to control charging and discharging of a Q node and a QB node; and a plurality of output buffers sequentially connected to the shift register, wherein each of the output buffers may include: a first transistor configured to transmit a voltage of the Q node to a Q' node; a pull-up transistor configured to output a clock signal to a gate line in response to a voltage of the Q' node; and a pull-down transistor configured to output a low-potential voltage to the gate line in response to a voltage of the QB node.

Each of the output buffers may further include a second transistor turned on according to the voltage of the Q node and configured to charge the Q' node with a high-potential voltage.

A gate electrode of the first transistor may be connected to the high-potential voltage that is a direct current power source.

Each of the output buffers may further include a third transistor turned on according to the voltage of the QB node and configured to discharge the Q' node.

The first transistor may be connected in a form of a diode between the Q node and the Q' node.

A gate electrode of the first transistor may be configured to receive a carry signal output from a previous stage circuit.

Each of the output buffers may further include: a second transistor turned on according to the voltage of the Q node and configured to transmit a high-potential voltage to the Q' node; and a third transistor turned on according to the voltage of the QB node and configured to transmit the low-potential voltage to the Q' node.

A gate electrode of the first transistor may be configured to receive the high-potential voltage that is a direct current power source or receive a carry signal output from a previous stage circuit.

The first transistor may be connected in a form of a diode between the Q node and the Q' node.

The first transistor and the second transistor may be configured to separately control charging and discharging of each Q node of the plurality of output buffers.

According to an aspect of the present disclosure, there is provided a display device including: a display panel configured to display an image; a data driver configured to apply a data signal to the display panel; and a gate driver including a plurality of stage circuits and configured to apply a gate signal to the display signal, wherein each of the plurality of the stage circuits may include: a shift register configured to control charging and discharging of a Q node and a QB node; and a plurality of output buffers sequentially connected to the shift register, wherein each of the output buffers may include: a first transistor configured to transmit a voltage of the Q node to a Q' node; a pull-up transistor configured to output a clock signal to a gate line in response to a voltage of the Q' node; and a pull-down transistor configured to output a low-potential voltage to the gate line in response to a voltage of the QB node.

According to embodiments, the gate driver and the display device including the same enable an implementation of a display device that has a narrow bezel by reducing the area of the gate driver resulting from a reduction in the number of shift registers.

In addition, according to embodiments, the gate driver and the display device including the same allow output of the gate signal to be uniform and stable by stably charging and discharging the gate voltage of the pull-up transistors that are provided at the buffers.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
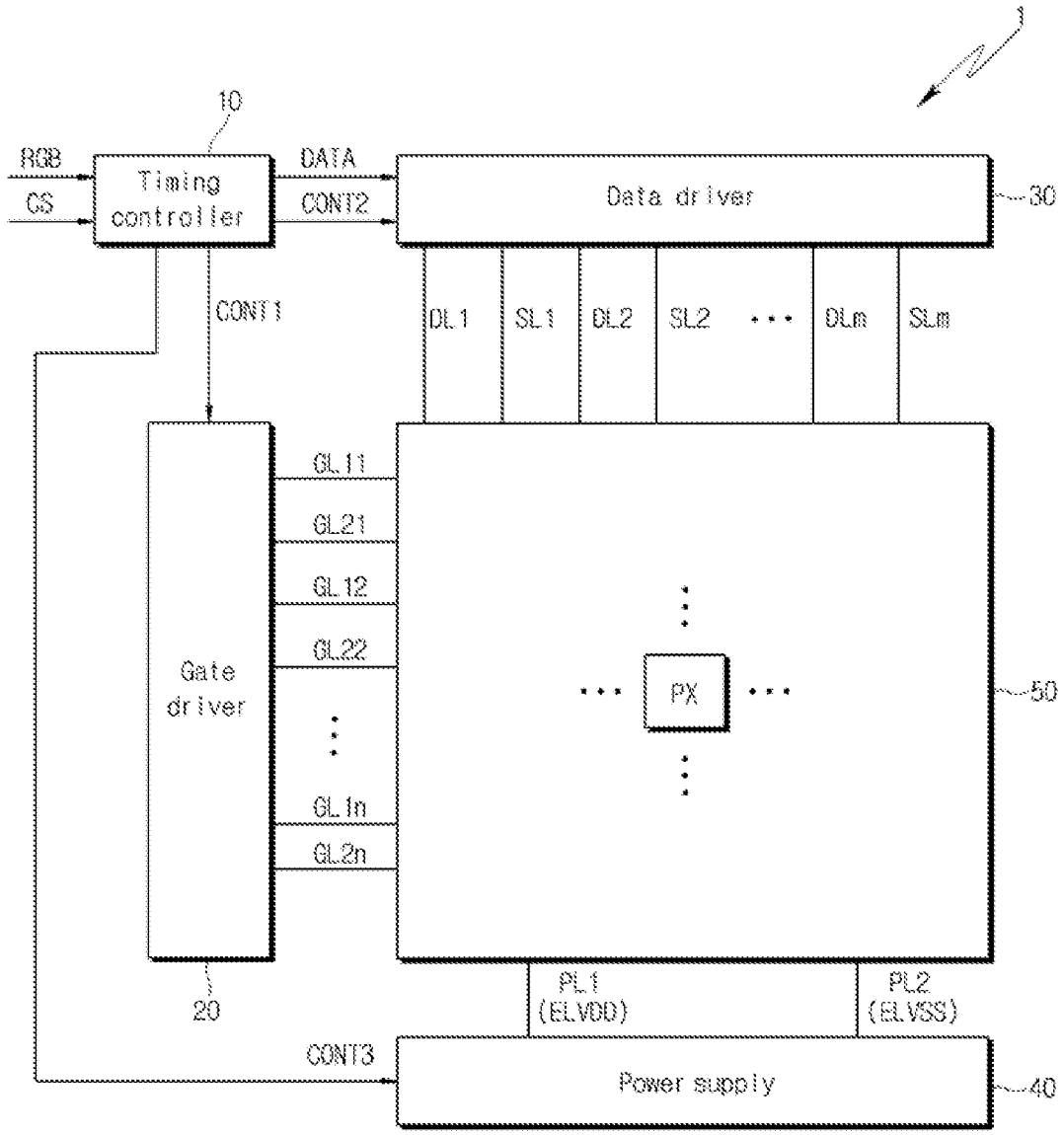
FIG. 1 is a block diagram illustrating a configuration of a display device according to an embodiment of the present disclosure.

Hereinafter, embodiments of the present disclosure will be described in detail with reference to the accompanying drawings. In this specification, it will be understood that when one component (or region, layer, portion) is referred to as being "on", "connected to", or "coupled to" another component, it can be directly disposed/connected/coupled on/to the another component, or an intervening third component may also be present.

Like reference numerals refer to like elements throughout. It will be understood that although the terms such as "first" and "second" are used herein to describe various elements, these elements should not be limited by these terms. The terms are only used to distinguish one component from other components. For example, an element referred to as a first element in one embodiment can be referred to as a second element in another embodiment without departing from the scope of the appended claims. The terms of a singular form may include plural forms unless referred to the contrary.

The meaning of the term "include" or "comprise" specifies presence of a property, a fixed number, a step, an operation, an element, a component or a combination thereof, but does not exclude presence or addition of other properties, fixed numbers, steps, operations, elements, components or combinations thereof.

FIG. 1 is a block diagram illustrating a configuration of a display device according to an embodiment of the present disclosure.

Referring to FIG. 1, a display device 1 includes a timing controller 10, a gate driver 20, a data driver 30, a power supply 40, and a display panel 50.

The timing controller 10 may receive an image signal RGB and a control signal CS from outside. The image signal RGB may include a plurality of gray scale data. The control signal CS may include, for example, a horizontal synchronization signal, a vertical synchronization signal, and a main clock signal.

The timing controller 10 may process the image signal RGB and the control signal CS to make the signals appropriate for an operation condition of the display panel 50, so that the timing controller 10 may generate and output image data DATA, a gate driving control signal CONT1, a data driving control signal CONT2, and a power supply control signal CONT3.

The gate driver 20 may generate gate signals on the basis of the gate driving control signal CONT1 output from the timing controller 10. The gate driver 20 may provide the generated gate signals to the pixels PXs through multiple first gate lines GL11 to GL1*n*.

The gate driver 20 may provide a sensing signal to the pixels PXs through multiple second gate lines GL21 to GL2*n*. The sensing signal may be supplied so as to measure a characteristic of a driving transistor and/or a light-emitting element provided inside the pixels PXs.

The data driver 30 may generate data signals on the basis of the image data DATA and the data driving control signal CONT2 output from the timing controller 10. The data driver 30 may provide the generated data signals to the pixels PXs through multiple data lines DL1 to DLm.

The data driver 30 may provide a reference voltage (a sensing voltage, or an initialization voltage) to the pixels PXs through multiple sensing lines SL1 to SLm, or may sense states of the pixels PXs on the basis of an electrical signal fed back from the pixels PXs.

The power supply 40 may generate a driving voltage to be provided to the display panel 50, on the basis of the power supply control signal CONT3. The driving voltage may include, for example, a high-potential driving voltage ELVDD and a low-potential driving voltage ELVSS. The power supply 40 may provide the generated driving voltages ELVDD and ELVSS to the pixels PXs, through corresponding power lines PL1 and PL2. In addition, the power supply 40 may supply a voltage required for driving the gate driver 20 and the data driver 30 and for generating a data voltage to the gate driver 20 and the data driver 30.

In the display panel 50, the multiple pixels PXs (or referred to as sub-pixels) are disposed. The pixels PXs may be, for example, arranged in a matrix form on the display panel 50. The pixels PXs may emit light with luminance corresponding to the gate signals and the data signals that are supplied through the first gate lines GL11 to GL1*n* and the data lines DL1 to DLm, respectively. In an embodiment, each pixel PX may display any one among red, green, blue, and white colors, but is not limited thereto.

The timing controller 10, the gate driver 20, the data driver 30, and the power supply 40 may be configured as separate integrated circuits (ICs), or ICs in which at least some thereof are integrated. For example, at least one among the data driver 30 and the power supply 40 may be configured as an integrated circuit integrated with the timing controller 10.

In addition, in FIG. 1, the gate driver 20 and the data driver 30 are illustrated as elements separated from the display panel 50, but at least one among the gate driver 20 and the data driver 30 may be configured in an in-panel manner that is formed integrally with the display panel 50. For example, the gate driver 20 may be formed in a bezel area of the display panel 50 according to a gate-in-panel (GIP) manner.

Figure 2:
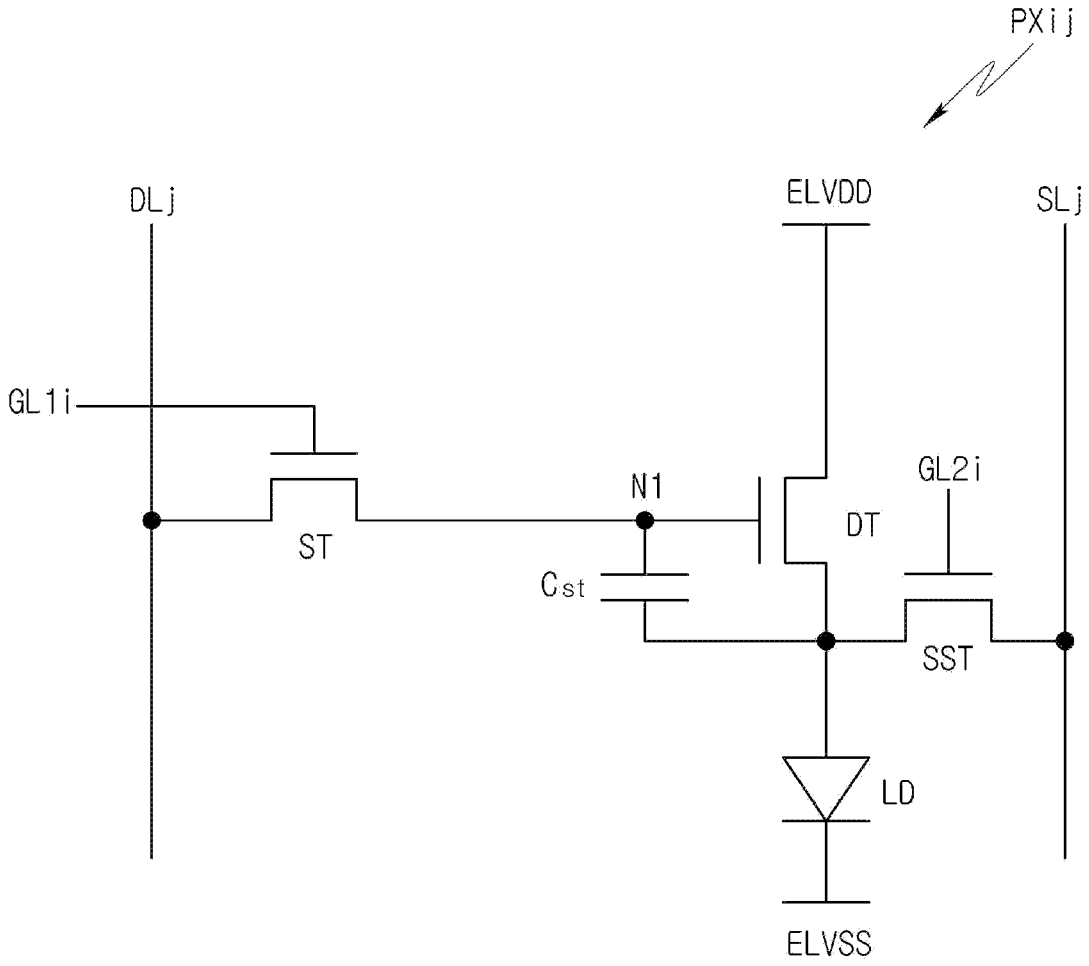
FIG. 2 is a circuit diagram illustrating an embodiment of a pixel illustrated in FIG. 1.

FIG. 2 is a circuit diagram illustrating an embodiment of a pixel illustrated in FIG. 1. FIG. 2 illustrates, as an example, a pixel PXij that is connected to an i-th first gate line GL1*i* and a j-th data line DLj.

Referring to FIG. 2, the pixel PX includes a switching transistor ST, a driving transistor DT, a sensing transistor SST, a storage capacitor Cst, and a light-emitting element LD.

A first electrode of the switching transistor ST is connected to the j-th data line DLj and a second electrode of the switching transistor ST is connected to a first node N1. A gate electrode of the switching transistor ST is connected to the i-th first gate line GL1*i*. The switching transistor ST is turned on when a gate signal at a gate-on level is applied through the i-th first gate line GL1*i*, and transmits a data signal applied through the j-th data line DLj, to the first node N1.

A first electrode of the storage capacitor Cst is connected to the first node N1, and a second electrode of the storage capacitor Cst may be configured to receive the high-potential driving voltage ELVDD. The storage capacitor Cst may be charged with a voltage corresponding to the difference between a voltage applied to the first node N1 and the high-potential driving voltage ELVDD.

A first electrode of the driving transistor DT is configured to receive the high-potential driving voltage ELVDD, and a second electrode of the driving transistor DT is connected to a first electrode (for example, an anode electrode) of the light-emitting element LD. A gate electrode of the driving transistor DT is connected to the first node N1. The driving transistor DT is turned on when a voltage at a gate-on level is applied through the first node N1, and may control the amount of a driving current flowing to the light-emitting element LD depending on a voltage provided to the gate electrode, that is, a voltage stored in the storage capacitor Cst.

A first electrode of the sensing transistor SST is connected to a j-th sensing line SLj, and a second electrode of the sensing transistor SST is connected to the first electrode of the light-emitting element LD. A gate electrode of the sensing transistor SST is connected to an i-th second gate line GL2*i*. The sensing transistor SST is turned on when a sensing signal at a gate-on level is applied through the i-th second gate line GL2*i*, and transmits a reference voltage applied through the j-th sensing line SLj, to the first electrode of the light-emitting element LD.

The light-emitting element LD outputs light corresponding to the driving current. The light-emitting element LD may be an organic light-emitting diode (OLED) or an ultra-small inorganic light-emitting diode having a size in a micro to nanoscale range, but the present disclosure is not limited thereto. Hereinafter, embodiments in which the light-emitting element LD is constructed as an organic light-emitting diode will be described.

In the present disclosure, the structure of the pixels PXs is not limited to that shown in FIG. 2. According to an embodiment, the pixels PXs may further include at least one element for compensating for a threshold voltage of the driving transistor DT, or initializing a voltage of the gate electrode of the driving transistor DT and/or a voltage of the anode electrode of the light-emitting element LD.

FIG. 2 illustrates an example in which the switching transistor ST, the driving transistor DT, and the sensing transistor SST are NMOS transistors, but the present disclosure is not limited thereto. For example, at least some or all of the transistors constituting each pixel PX may be constructed as PMOS transistors. In various embodiments, each of the switching transistor ST, the driving transistor DT, and the sensing transistor SST may be implemented as a low-temperature polycrystalline silicon (LTPS) thin-film transistor, an oxide thin-film transistor, or a low-temperature polycrystalline oxide (LTPO) thin-film transistor.

Figure 3:
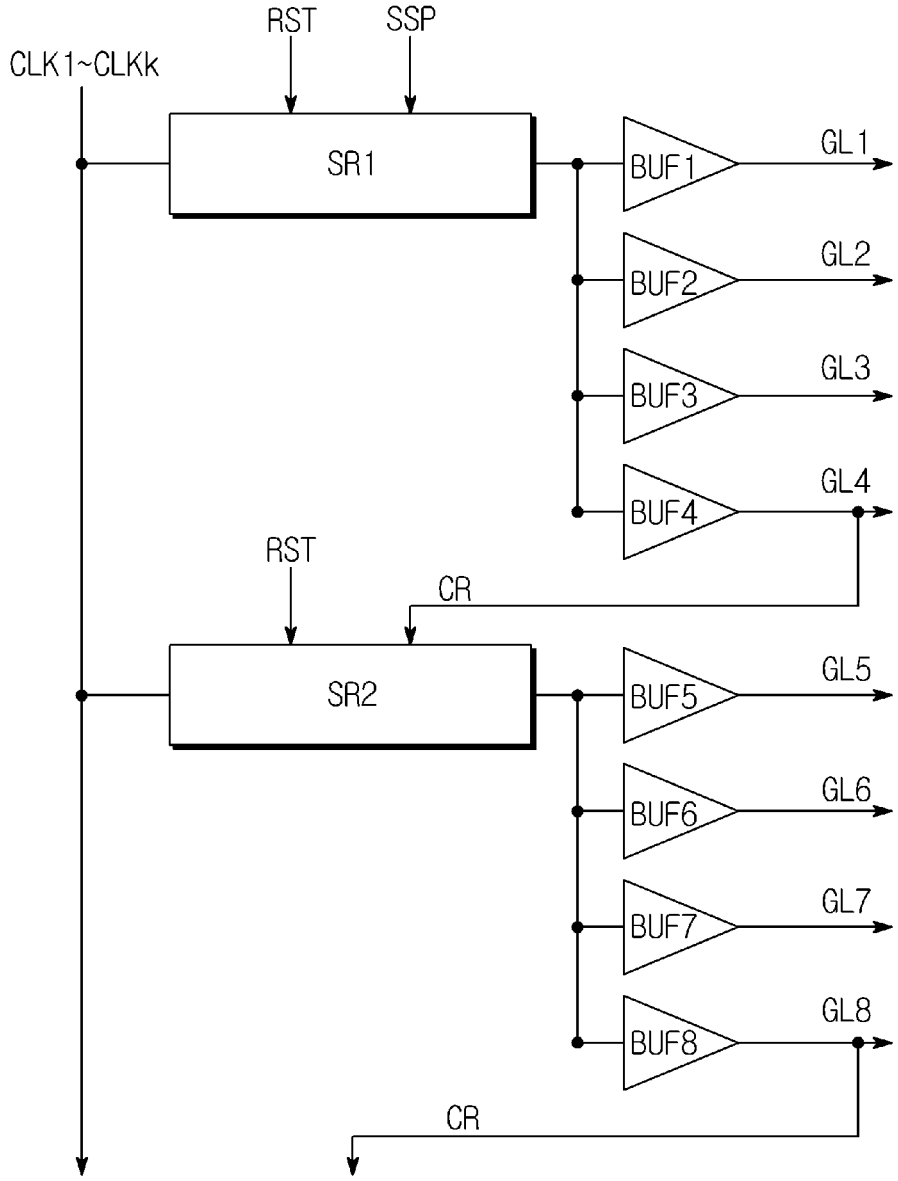
FIG. 3 is a view schematically illustrating a configuration of a gate driver according to an embodiment of the present disclosure.

FIG. 3 is a view schematically illustrating a configuration of a gate driver according to an embodiment of the present disclosure.

The gate driver 20 according to an embodiment of the present disclosure generates the gate signals on the basis of the gate driving control signal CONT1 applied from the timing controller 10, and the generated gate signals are sequentially applied to gate lines GL1 to GL8.

Referring to FIG. 3, the gate driver 20 may include a plurality of stage circuits. The stage circuits may receive at least one clock signals CLK1 to CLKk. The clock signals CLK1 to CLKk may be a square wave signal in which a gate-on voltage for turning-on transistors constituting the stage circuit and a gate-off voltage for turning-off the transistors constituting the stage circuit are repeated.

Each stage circuit includes: shift registers SR1 and SR2 that are dependently connected through a carry signal line; and buffers BUF1 to BUF4 and BUF5 to BUF 8 that are connected to the shift registers SR1 and SR2, respectively.

The shift registers SR1 and SR2 of each stage circuit may receive a scan start signal SSP or a carry signal CR that is output from a previous stage circuit. For example, a first shift register SR1 of a first stage circuit may receive the scan start signal SSP, and a second shift register SR2 of the remaining stage circuits may receive the carry signal CR output from the previous stage circuit. The shift resistors SR1 and SR2 may be charged with a node voltage of an output end thereof in response to the scan start signal SSP or the carry signal CR.

In an embodiment, the shift registers SR1 and SR2 may further receive the carry signal CR output from the shift register of a next stage circuit. However, the embodiment is not limited thereto.

The shift registers SR1 and SR2 may further receive a reset signal RST. The shift registers SR1 and SR2 may discharge the node voltage of the output end thereof in response to the reset signal RST.

The buffers BUF1 to BUF4 and BUF5 to BUF8 of each stage circuit may be sequentially connected to the output end of the shift registers SR1 and SR2, respectively. In the embodiment, the stage circuit may have a multi-buffer structure in which multiple buffers BUF1 to BUF8 are connected to one of the shift registers SR1 and SR2. For example, a first to a fourth buffers BUF1 to BUF4 may be connected to the first shift register SR1, and a fifth to an eighth buffers BUF5 to BUF8 may be connected to the second shift register SR2. Although it is illustrated in FIG. 3 that four buffers BUF1 to BUF4 and BUF5 to BUF8 are connected to one of the shift registers SR1 and SR2 as an example, fewer or a greater number of buffers may be connected to one of the shift registers SR1 and SR2.

Generally, since the shift registers SR1 and SR2 are formed of multiple transistors, the gate driver 20 occupies a large area when the gate driver 20 is disposed on the display panel 50, so that the bezel area may be widened.

In the embodiment, the stage circuit is configured such that one of the shift registers SR1 and SR2 outputs the gate signals to the plurality of gate lines GL1 to GL8. Therefore, the number of shift registers SR1 and SR2 within the gate driver 20 is reduced, and an area of the gate driver 20 is reduced, thereby enabling an implementation of a narrow bezel.

Each buffer BUF1 to BUF4 and BUF5 to BUF8 may output the clock signals CLK1 to CLKk in response to the node voltage of the output end of the connected shift registers SR1 and SR2. As the gate signals, the output clock signals CLK1 to CLKk are applied to the gate lines GL1 to GL8.

When the pixels PXs connected to the gate driver 20 have the same structure as illustrated in FIG. 2, the gate signals may include a first gate signal and a second gate signal. However, the embodiment is not limited thereto.

The gate signals, as the carry signal CR, output from the last buffers BUF4 and BUF8 of each stage circuit may be applied to the shift register of the next stage circuit through the carry signal lines. Although it is illustrated in FIG. 3 that the shift registers SR1 and SR2 are directly connected to the shift register of the next stage circuit through the carry signal lines, the embodiment is not limited thereto. In another embodiment, the shift resistors SR1 and SR2 may be connected to any shift register which is disposed after a corresponding shift registers SR1 and SR2 through the carry signal lines.

Hereinafter, the multi-buffer structure of the stage circuit will be described in more detail.

Figure 4:
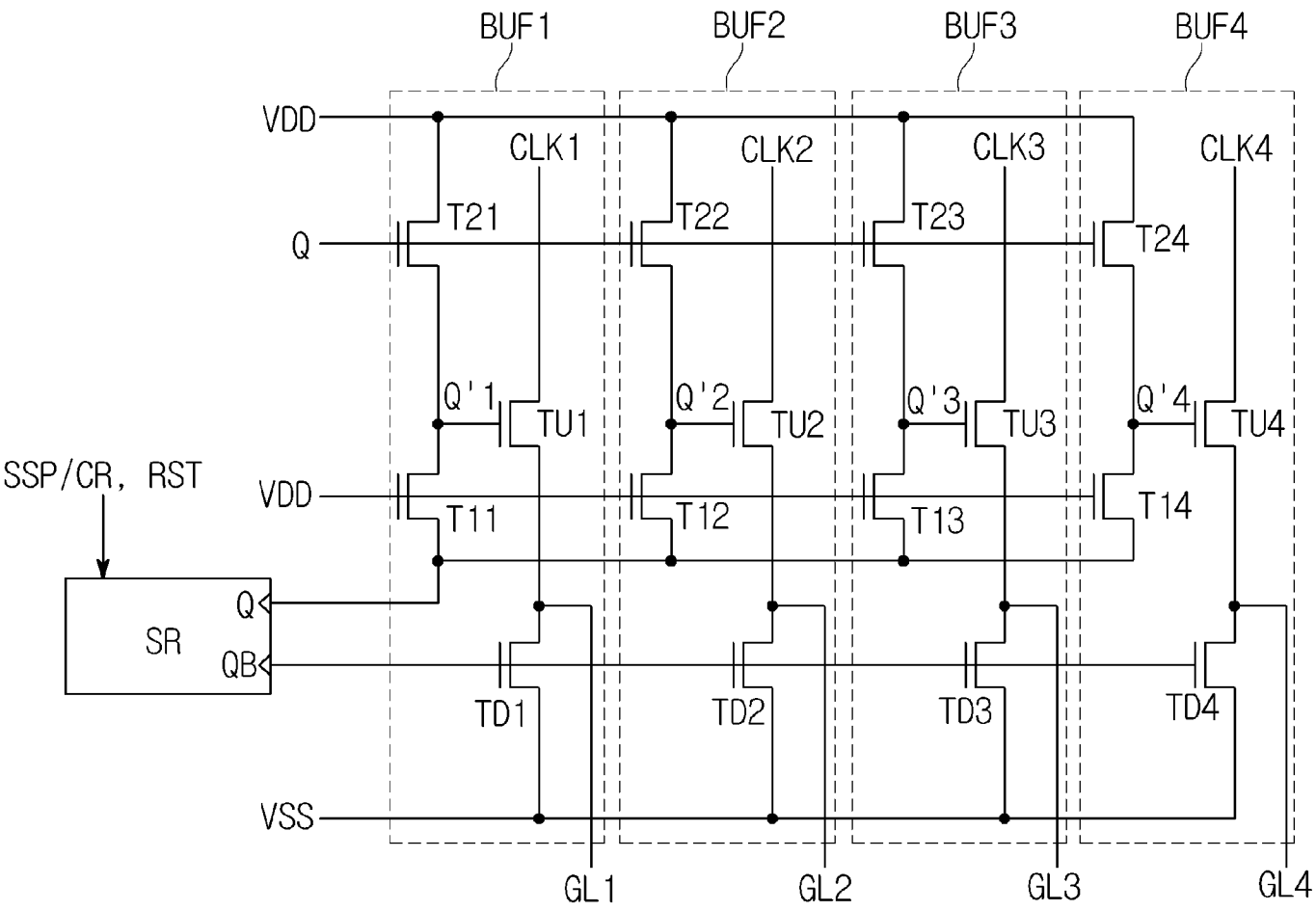
FIG. 4 is a circuit diagram illustrating a structure of multiple buffers according to a first embodiment of the present disclosure.

FIG. 4 is a circuit diagram illustrating a structure of multiple buffers according to a first embodiment of the present disclosure.

Referring to FIG. 4, the stage circuit includes the shift register SR and multiple buffers BUF1 to BUF4 connected to the shift register SR.

The shift resistor SR may charge and discharge a voltage of a Q node and a QB node (or simply referred as "charge and discharge a Q node and a QB node") in response to the signals (scan start signal SSP or carry signal CR, reset signal RST) that are input. For example, the shift registers SR1 and SR2 may charge the voltage of the Q node in response to the scan start signal SSP or the carry signal CR, and may charge or discharge the node of the output end thereof in response to the clock signals CLK1 to CLKk. When the voltage of the Q node is charged, the voltage of the QB node may be discharged. When the voltage of the Q node is discharged, the voltage of the QB node may be charged.

Each buffer BUF1 to BUF4 may include respective first transistors T11, T12, T13, and T14 that are connected between the Q node and a Q' nodes Q'1, Q'2, Q'3, and Q'4. A gate electrode of each first transistor T11, T12, T13, and T14 is connected to a high-potential voltage VDD. The high-potential voltage VDD may be a direct current voltage at a gate-on level. The first transistors T11, T12, T13, and T14 may transmit the voltage of the Q node to the Q' nodes Q'1, Q'2, Q'3, and Q'4 while in a turn-on state.

A first end of each buffer BUF1 to BUF4 is configured to receive the clock signals CLK1 to CLK4, respectively, and a second end of each buffer BUF1 to BUF4 is connected to the gate lines GL1 to GL4. Further, the buffers BUF1 to BUF4 include respective pull-up transistors TU1 to TU4 in which gate electrodes thereof are connected to the Q' nodes Q'1, Q'2, Q'3, and Q'4, respectively. The pull-up transistors TU1 to TU4 are turned-on in response to the voltage of the Q' nodes Q'1, Q'2, Q'3, and Q'4, and output the input clock signals CLK1 to CLK4 to the gate lines GL1 to GL4. The buffers BUF1 to BUF4 may further include pull-down transistors TD1 to TD4, respectively, that are turned on in response to the voltage of the QB node and output a low-potential voltage VSS to the gate lines GL1 to GL4. The low-potential voltage VSS may be a direct current voltage at a gate-off level.

In an embodiment as described above, the first transistors T11, T12, T13, and T14 remain in a turned-on state while the stage circuit is driven by the high-potential voltage VDD that is a direct current voltage. Then, the first transistors T11, T12, T13, and T14 may be quickly deteriorated, and characteristics thereof may vary. For example, when a threshold voltage of the first transistors T11, T12, T13, and T14 increases, the voltage of the Q' node may decrease by the increased threshold voltage. Therefore, a gate-source voltage at the pull-up transistors TU1 to TU4 that are provided at the output buffers BUF1 to BUF4 is changed, so that outputs of the output buffers BUF1 to BUF4 are lowered and become inhomogeneous.

In order to avoid this problem, in the embodiment, the output buffers BUF1 to BUF4 further include second transistors T21, T22, T23, and 124 that are separately charging the Q' nodes Q'1, Q'2, Q'3, and Q'4, respectively, in response to the voltage of the Q node. The second transistors T21, T22, T23, and T24 may be connected between the high-potential voltage VDD and the Q' nodes Q'1, Q'2, Q'3, and Q'4, respectively, and a gate node thereof may be connected to the Q node. The second transistors T21, T22, T23, and T24 are turned-on when the Q node is charged, and transmit the high-potential voltage VDD to the Q' nodes Q'1, Q'2, Q'3, and Q'4, so that the Q' nodes Q'1, Q'2, Q'3, and Q'4 may be effectively charged. In other words, the first transistor and the second transistor may be configured to separately control charging and discharging of each Q node of the plurality of output buffers BUF1 to BUF4.

In the embodiment, although the first transistors T11, T12, T13, and 114 are deteriorated, the Q' nodes Q'1, Q'2, Q'3, and Q'4 are capable of being charged through the second transistors T21, T22, T23, and T24. Therefore, the pull-up transistors TU1 to TU4 of each of the output buffers BUF1 to BUF4 may be stably turned-on. Therefore, in the embodiment, an effect caused by the deterioration of the first transistors T11, T12, T13, and 114 may be minimized, and an output of the gate-on voltage to the gate lines may be uniformly performed and stabilized.

Figure 5:
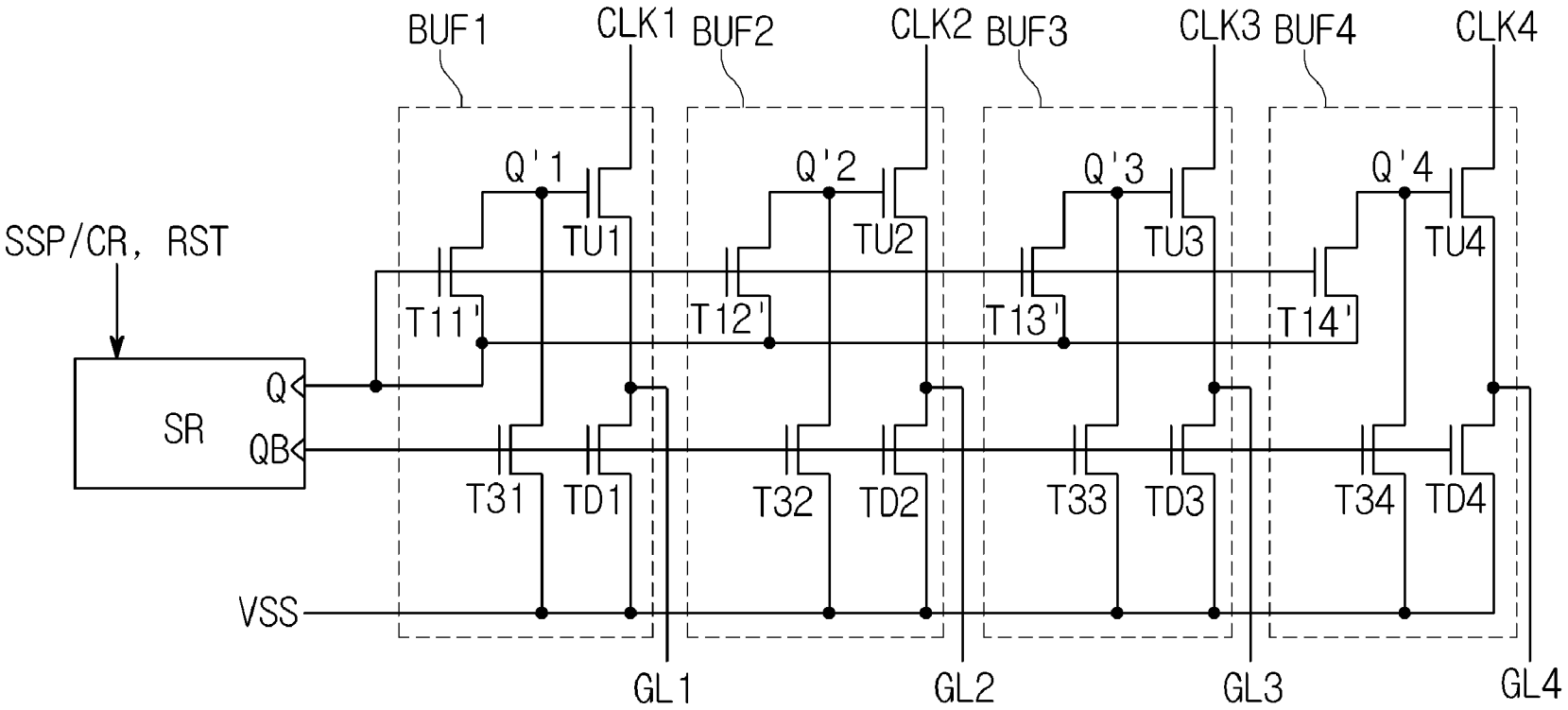
FIG. 5 is a circuit diagram illustrating a structure of multiple buffers according to a second embodiment of the present disclosure.

FIG. 5 is a circuit diagram illustrating a structure of multiple buffers according to a second embodiment of the present disclosure.

Compared with the embodiment in FIG. 4, in the embodiment illustrated in FIG. 5, the first transistors T11', T12', T13', and T14' are connected in the form of a diode between the Q node and the Q' nodes Q'1, Q'2, Q'3, and Q'4, respectively. The first transistors T11', T12', T13', and T14' are turned on in response to the voltage of the Q node and transmit the voltage of the Q node to the Q' nodes Q'1, Q'2, Q'3, and Q'4. The first transistors T11', T12', T13', and T14' are connected in the form of the diode, so that the voltage of the Q node may be stably transmitted to the Q' nodes Q'1, Q'2, Q'3, and Q'4.

Each buffer BUF1 to BUF4 may include: respective pull-up transistors TU1 to TU4 that are turned-on in response to the voltage of the Q' nodes Q'1, Q'2, Q'3, and Q'4, and output the input clock signals CLK1 to CLK4 to the gate lines GL1 to GL4; and respective pull-down transistors TD1 to TD4 that are turned-on in response to the voltage of the QB node, and output the low-potential voltage VSS to the gate lines GL1 to GL4.

In the embodiment, the buffers BUF1 to BUF4 further includes third transistors T31, T32, T33, and 134, respectively, that are separately discharging the Q' nodes Q'1, Q'2, Q'3, and Q'4 in response to the voltage of the QB node. The third transistors T31, T32, T33, and 134 may be connected between the low-potential voltage VSS and the Q' nodes Q'1, Q'2, Q'3, and Q'4, respectively, and the gate node thereof may be connected to the QB node. The third transistors T31, T32, T33, and 134 are turned-on when the QB node is charged, and transmit the low-potential voltage VSS to the Q' nodes Q'1, Q'2, Q'3, and Q'4, so that the Q' nodes Q'1, Q'2, Q'3, and Q'4 may be effectively discharged.

In the embodiment, although the first transistors T11', T12', T13', T14' are deteriorated, the Q' nodes Q'1, Q'2, Q'3, and Q'4 are capable of being discharged through the third transistors T31, T32, T33, and T34. Therefore, the pull-up transistors TU1 to TU4 of the output buffers BUF1 to BUF4 may be stably turned-off. Therefore, in the embodiment, an effect caused by the deterioration of the first transistors T11', T12', T13', and T14' may be minimized, and an output of the gate-off voltage to the gate lines may be uniformly performed and stabilized.

Figure 6:
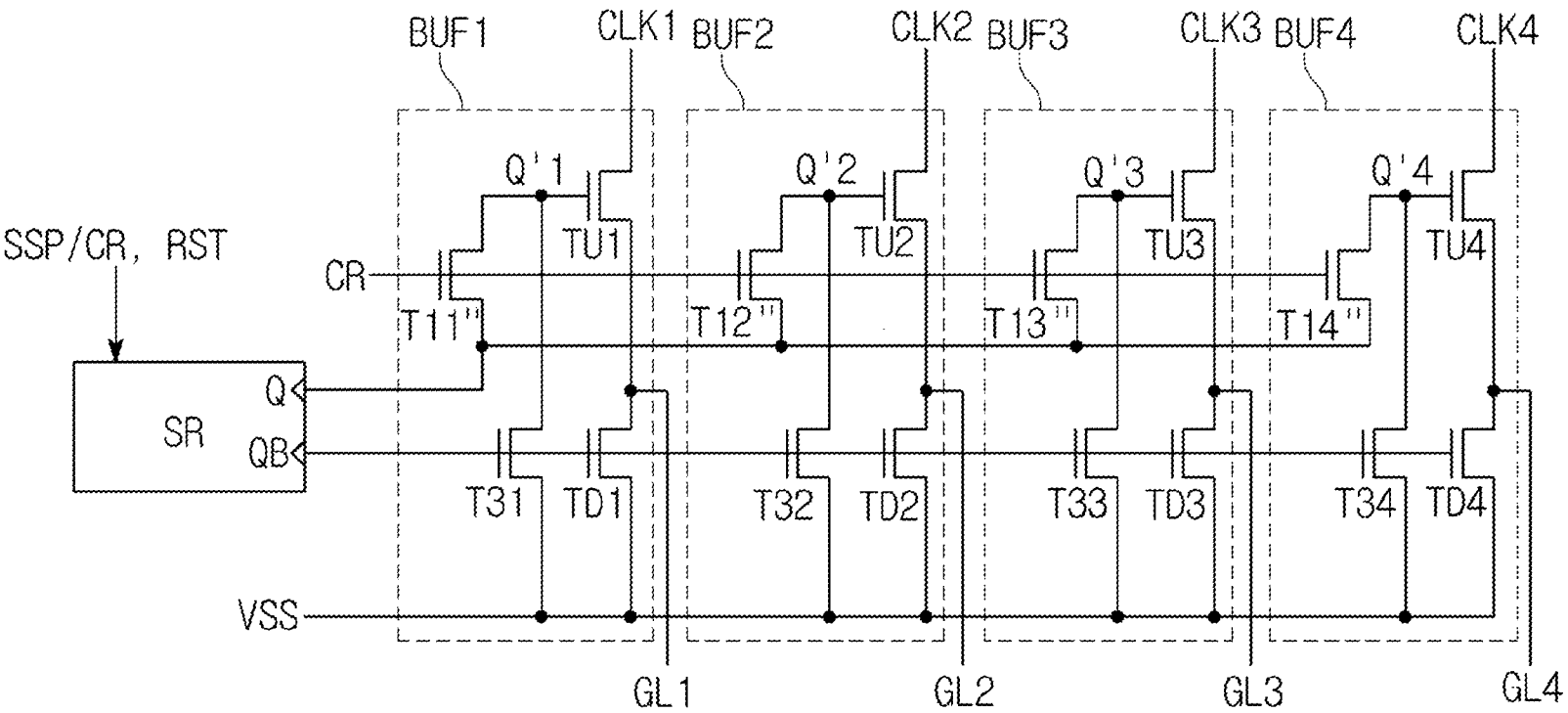
FIG. 6 is a circuit diagram illustrating a structure of multiple buffers according to a third embodiment of the present disclosure.

FIG. 6 is a circuit diagram illustrating a structure of multiple buffers according to a third embodiment of the present disclosure.

Compared with the embodiment in FIG. 5, in the embodiment illustrated in FIG. 6, the first transistors T11", T12", T13", and T14" are connected between the Q node and the Q' nodes Q'1, Q'2, Q'3, and Q'4, respectively, and the gate electrode thereof is configured to receive the carry signal CR output from the previous stage circuit. The first transistors T11", T12", T13", and T14" may be turned-on when the carry signal CR at a gate-on level is applied from the previous stage circuit, and the voltage of the Q node may be transmitted to the Q' nodes Q'1, Q'2, Q'3, and Q'4.

Each buffer BUF1 to BUF4 may include: respective pull-up transistors TU1 to TU4 that are turned-on in response to the voltage of the Q' nodes Q'1, Q'2, Q'3, and Q'4, and output the input clock signals CLK1 to CLK4 to the gate lines GL1 to GL4; and respective pull-down transistors TD1 to TD4 that are turned-on in response to the voltage of the QB node, and output the low-potential voltage VSS to the gate lines GL1 to GL4.

In the embodiment, the buffers BUF1 to BUF4 further includes third transistors T31, T32, T33, and 134, respectively, that are separately discharging the Q' nodes Q'1, Q'2, Q'3, and Q'4 in response to the voltage of the QB node. The third transistors T31, T32, T33, and T34 may be connected between the low-potential voltage VSS and the Q' nodes Q'1, Q'2, Q'3, and Q'4, respectively, and the gate node thereof may be connected to the QB node. The third transistors T31, T32, T33, and 134 are turned-on when the QB node is charged, and transmit the low-potential voltage VSS to the Q' nodes Q'1, Q'2, Q'3, and Q'4, so that the Q' nodes Q'1, Q'2, Q'3, and Q'4 may be effectively discharged.

Figure 7:
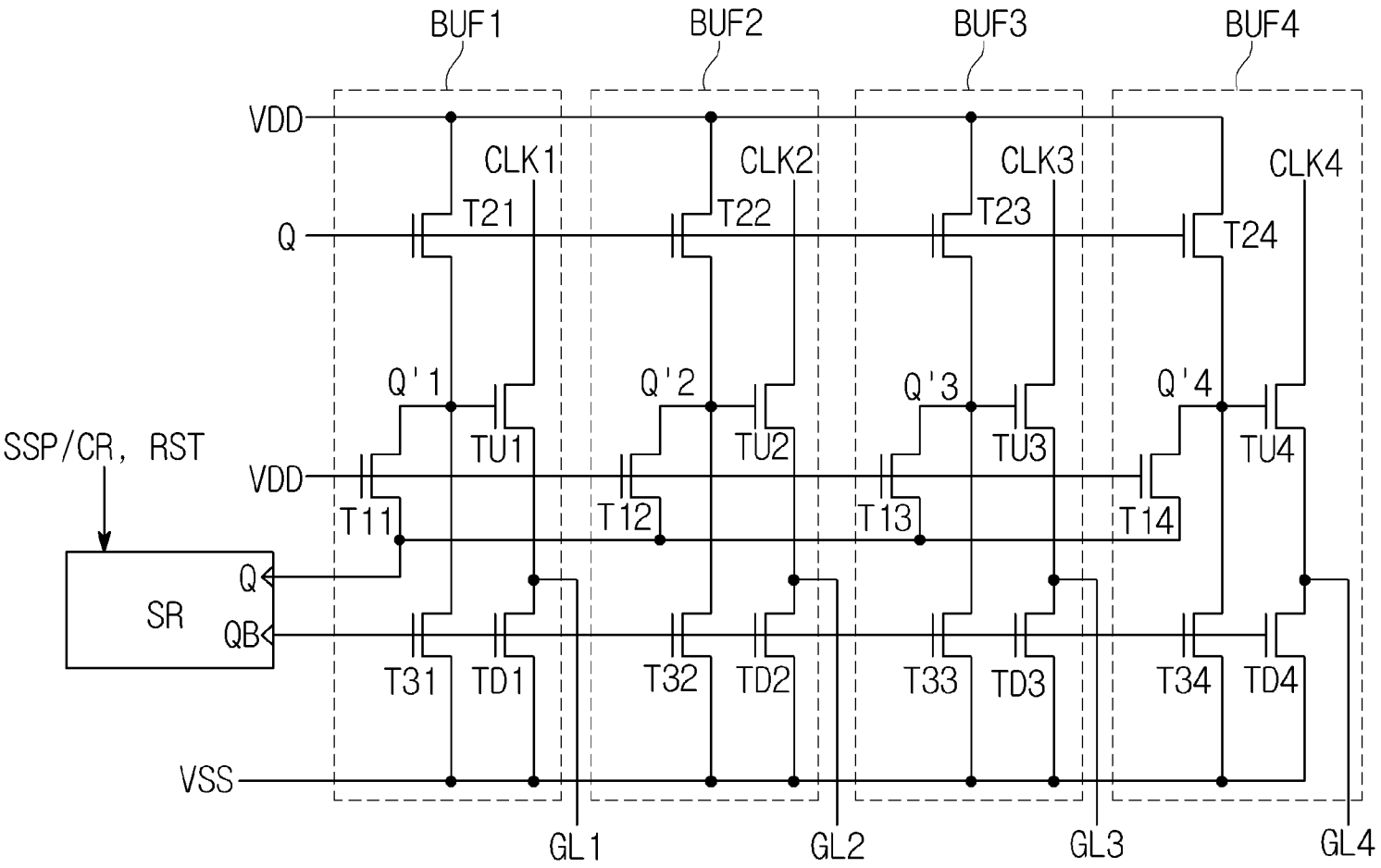
FIG. 7 is a circuit diagram illustrating a structure of multiple buffers according to a fourth embodiment of the present disclosure.

FIG. 7 is a circuit diagram illustrating a structure of multiple buffers according to a fourth embodiment of the present disclosure.

Referring to FIG. 7, each buffer BUF1 to BUF4 may include respective first transistors T11, T12, T13, and 114 that are connected between the Q node and the Q' nodes Q'1, Q'2, Q'3, and Q'4, respectively. The gate electrode of each first transistor T11, T12, T13, and 114 is connected to the high-potential voltage VDD. The high-potential voltage VDD may be a direct current voltage at a gate-on level. The first transistors T11, T12, T13, and 114 may transmit the voltage of the Q node to the Q' node while in a turn-on state.

In the embodiment, each buffer BUF1 to BUF4 further includes respective second transistors T21, T22, T23, and 124 that are separately charging the Q' nodes Q'1, Q'2, Q'3, and Q'4 in response to the voltage of the Q node. The second transistors T21, T22, T23, and T24 may be connected between the high-potential voltage VDD and the Q' nodes Q'1, Q'2, Q'3, and Q'4, respectively, and the gate node thereof may be connected to the Q node. The second transistors T21, T22, T23, and T24 are turned-on when the Q node is charged, and transmit the high-potential voltage VDD to the Q' nodes Q'1, Q'2, Q'3, and Q'4, so that the Q' nodes Q'1, Q'2, Q'3, and Q'4 may be effectively charged.

In addition, in the embodiment, each buffer BUF1 to BUF4 further includes respective third transistors T31, T32, T33, and 134 that are separately discharging the Q' nodes Q'1, Q'2, Q'3, and Q'4 in response to the voltage of the QB node. The third transistors T31, T32, T33, and 134 may be connected between the low-potential voltage VSS and the Q' nodes Q'1, Q'2, Q'3, and Q'4, respectively, and the gate node thereof may be connected to the QB node. The third transistors T31, T32, T33, and 134 are turned-on when the QB node is charged, and transmit the low-potential voltage VSS to the Q' nodes Q'1, Q'2, Q'3, and Q'4, so that the Q' nodes Q'1, Q'2, Q'3, and Q'4 may be effectively discharged.

In FIG. 7, an embodiment that the gate electrode of each first transistor T11, T12, T13, and 114 is connected to the high-potential voltage VDD is illustrated. However, the embodiment is not limited thereto. For example, in another embodiment, the first transistors T11', T12', T13', and T14' are connected in the form of the diode between the Q node and the Q' nodes Q'1, Q'2, Q'3, and Q'4, respectively, as an embodiment illustrated in FIG. 5. In still another embodiment, the first transistors T11", T12", T13", and T14" illustrated in an embodiment in FIG. 6 may be connected between the Q node and the Q' nodes Q'1, Q'2, Q'3, and Q'4, and the gate electrode thereof may be configured to receive the carry signal CR output from the previous stage circuit.

It will be understood by those skilled in the art that the present disclosure can be embodied in other specific forms without changing the technical idea or essential characteristics of the present disclosure. Therefore, it should be understood that the embodiments described above are illustrative in all aspects and not restrictive. The scope of the present disclosure is characterized by the appended claims rather than the detailed description described above, and it should be construed that all alterations or modifications derived from the meaning and scope of the appended claims and the equivalents thereof fall within the scope of the present disclosure.

What is claimed is:

1. A gate driver comprising:

a plurality of stage circuits, wherein each of the plurality of stage circuits comprises:

a shift register configured to control charging and discharging of a Q node and a QB node; and a plurality of output buffers sequentially connected to the shift register, wherein each of the output buffers comprises:

a first transistor configured to transmit a voltage of the Q node to a Q' node, the first transistor including a gate electrode, a first electrode, and a second electrode that is connected to the Q node;

a pull-up transistor configured to output a clock signal to a gate line in response to a voltage of the Q' node, the pull-up transistor including a gate electrode that is connected to the first electrode of the first transistor;

a pull-down transistor configured to output a low-potential voltage to the gate line in response to a voltage of the QB node, and wherein each of the output buffers further comprises a second transistor turned on according to the voltage of the Q node and configured to charge the Q' node with a high-potential voltage, the second transistor including a gate electrode that is connected to the Q node, a first electrode that is connected to a power line that supplies the high-potential voltage, and a second electrode that is connected to the first electrode of the first transistor and the gate electrode of the pull-up transistor.

2. The gate driver of claim 1, wherein the gate electrode of the first transistor is connected to the power line that supplies the high-potential voltage that is a direct current power source.

3. The gate driver of claim 1, wherein each of the output buffers further comprises a third transistor turned on according to the voltage of the QB node and configured to discharge the Q' node.

4. The gate driver of claim 3, wherein the first transistor is connected in a form of a diode between the Q node and the Q' node.

5. The gate driver of claim 3, wherein the gate electrode of the first transistor is configured to receive a carry signal output from a previous stage circuit.

6. The gate driver of claim 3, wherein the gate electrode of the first transistor is configured to receive the high-potential voltage that is a direct current power source or receive a carry signal output from a previous stage circuit.

7. The gate driver of claim 3, wherein the first transistor is connected in a form of a diode between the Q node and the Q' node.

8. The gate driver of claim 3, wherein the first transistor and the second transistor are configured to separately control charging and discharging of each Q node of the plurality of output buffers.

9. A display device comprising:

a display panel configured to display an image;

a data driver configured to apply a data signal to the display panel; and a gate driver comprising a plurality of stage circuits and configured to apply a gate signal to the display panel, wherein each of the plurality of the stage circuits comprises:

a shift register configured to control charging and discharging of a Q node and a QB node; and a plurality of output buffers sequentially connected to the shift register, wherein each of the output buffers comprises:

a first transistor configured to transmit a voltage of the Q node to a Q' node, the first transistor including a gate electrode, a first electrode, and a second electrode that is connected to the Q node;

a pull-up transistor configured to output a clock signal to a gate line in response to a voltage of the Q' node, the pull-up transistor including a gate electrode that is connected to the first electrode of the first transistor; and a pull-down transistor configured to output a low-potential voltage to the gate line in response to a voltage of the QB node, and wherein each of the output buffers further comprises a second transistor turned on according to the voltage of the Q node and configured to charge the Q' node with a high-potential voltage, the second transistor including a gate electrode that is connected to the Q node, a first electrode that is connected to a power line that supplies the high-potential voltage, and a second electrode that is connected to the first electrode of the first transistor and the gate electrode of the pull-up transistor.

10. The display device of claim 9, wherein the gate electrode of the first transistor is connected to the power line that supplies the high-potential voltage that is a direct current power source.

11. The display device of claim 9, wherein each of the output buffers further comprises a third transistor turned on according to the voltage of the QB node and configured to discharge the Q' node.

12. The display device of claim 11, wherein the first transistor is connected in a form of a diode between the Q node and the Q' node.

13. The display device of claim 11, wherein the power line that supplies gate electrode of the first transistor is configured to receive a carry signal output from a previous stage circuit.

14. The display device of claim 11, wherein the gate electrode of the first transistor is configured to receive the high-potential voltage that is a direct current power source or receive a carry signal output from a previous stage circuit.

15. The display device of claim 11, wherein the first transistor is connected in a form of a diode between the Q node and the Q' node.

* * * * *